US005581958A

United States Patent [19]

Coté

[11] Patent Number: 5,581,958

[45] Date of Patent: Dec. 10, 1996

[54] POLE AND CABINET STRUCTURE FOR ANTENNA-MOUNTING AT COMMUNICATIONS SITE

[75] Inventor: James R. Coté, Dunlap, Ill.

[73] Assignee: UNR Industries, Inc., Chicago, Ill.

[21] Appl. No.: 379,362

[22] Filed: Jan. 27, 1995

[51] Int. Cl.[6] ..... H01Q 1/12

[52] U.S. Cl. ..... 52/40; 52/726.4; 52/736.1; 343/890; 343/720

[58] Field of Search ..... 52/40, 726.4, 726.3, 52/731.2, 731.4, 732.1, 732.3, 736.1, 736.2, 736.3, 721.2, 722.1, 173.1, 726.4, 40; 312/100; 174/45 R; 343/890, 898, 720

[56] References Cited

U.S. PATENT DOCUMENTS

| | | | |
|---|---|---|---|
| 426,660 | 4/1890 | Carroll | 52/40 X |
| 831,327 | 9/1906 | Daly | 174/457 R X |
| 1,085,144 | 1/1914 | Massey | 52/40 X |
| 1,162,657 | 11/1915 | Schweitzer | 174/45 R X |
| 1,224,966 | 5/1917 | Schweitzer | 174/45 R X |
| 3,045,783 | 7/1962 | Daniels | 52/736.2 X |
| 3,325,950 | 6/1967 | Pfaff | 52/726.4 X |
| 3,706,839 | 12/1972 | Comte et al. | 174/45 R |
| 5,446,473 | 8/1995 | Nielsen . | |

FOREIGN PATENT DOCUMENTS

| | | | |
|---|---|---|---|
| 0302823 | 12/1928 | United Kingdom | 52/726.4 |
| 0751685 | 7/1956 | United Kingdom | 52/726.4 |

*Primary Examiner*—Robert Canfield
*Attorney, Agent, or Firm*—Dressler, Goldsmith, Milnamow & Katz, Ltd.

[57] ABSTRACT

A structure is disclosed, which has fiberglass components and which is useful for mounting an antenna at a communications site. The integrated structure comprises an upper, tubular pole, a lower, tubular pole, and a hollow cabinet having at least one door. The upper pole extends upwardly from the cabinet. The lower pole extends downwardly from the cabinet. Preferably, an integrated wall defines and encloses the upper and lower poles and the cabinet, except where the cabinet has at least one door. Alternatively, the upper pole is telescoped over a tubular flange extending upwardly from the cabinet and an integrated wall defines and encloses the lower pole and the cabinet, except where the cabinet has at least one door. In either instance, both poles communicate with the cabinet, and the cabinet has a rigid frame within such wall and a rigid floor within the frame.

5 Claims, 2 Drawing Sheets

FIG. 1
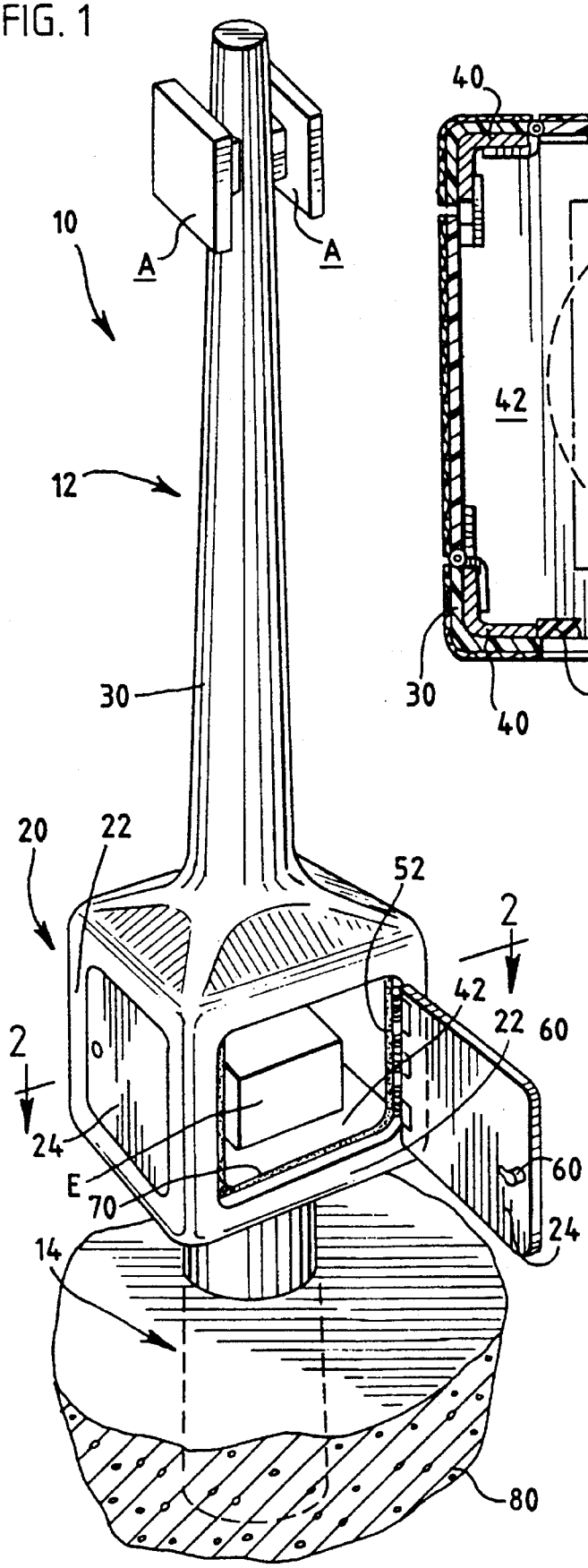
FIG. 2
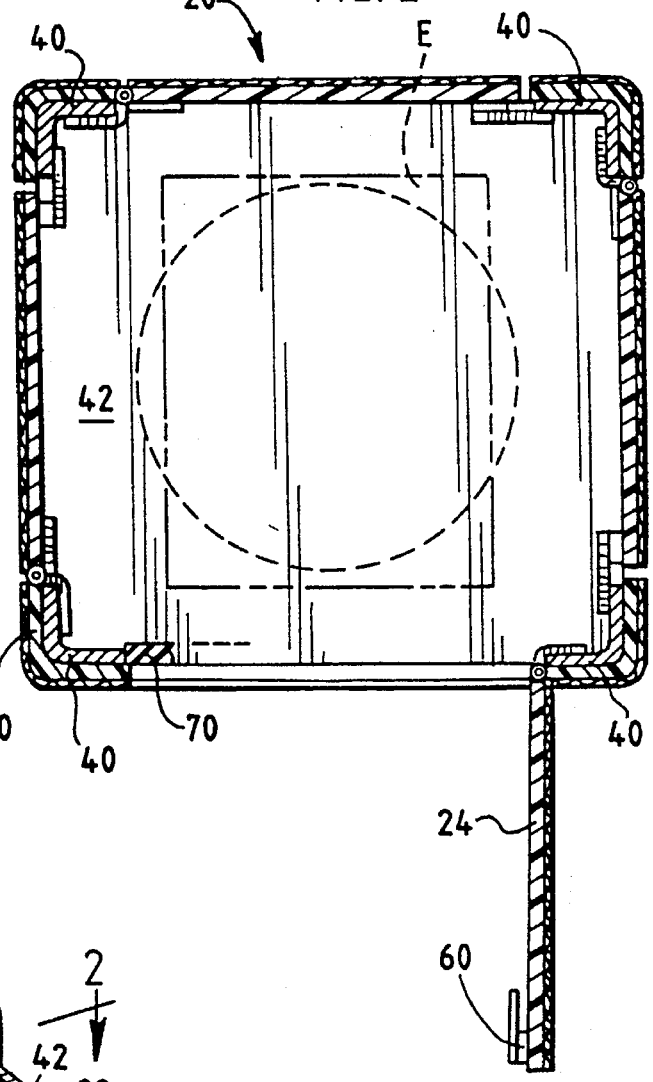
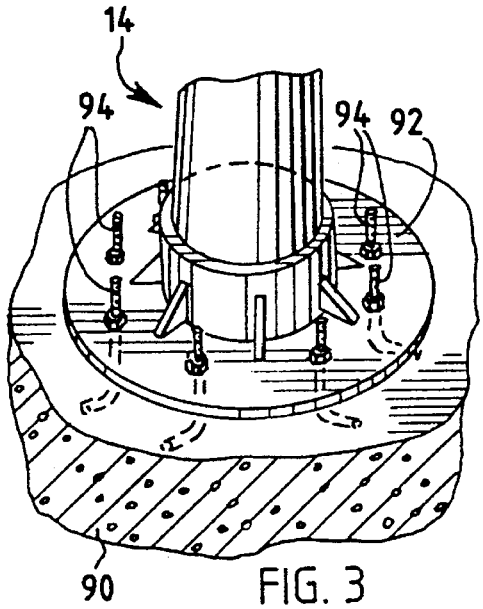
FIG. 3

POLE AND CABINET STRUCTURE FOR ANTENNA-MOUNTING AT COMMUNICATIONS SITE

TECHNICAL FIELD OF THE INVENTION

This invention pertains to a structure combining a tubular pole and a hollow cabinet and useful for mounting an antenna at a communications site. The pole extends upwardly from and communicates with the cabinet. The pole and the cabinet may be made predominantly from fiberglass.

BACKGROUND OF THE INVENTION

Antenna-mounting poles are used widely at communications sites for cellular telephone communications, personal communication systems, and other wireless communications. It is known for such poles to be made predominantly from fiberglass.

Commonly, it is necessary to mount a cabinet containing electrical equipment near such a pole and to run electrical cables from the cabinet, into and through the pole. It is known for such a cabinet to be strapped to such a pole. It also is known for such a cabinet and such a pole to be mounted on a common foundation.

SUMMARY OF THE INVENTION

This invention combines such a pole and such a cabinet into one structure, in which the pole extends upwardly from and communicates with the cabinet. The pole and the cabinet may be made predominantly from fiberglass.

Preferably, the structure is an integrated structure having an integrated wall, which defines and encloses the pole and the cabinet, except where the cabinet has at least one door. Alternatively, the pole is telescoped over a tubular flange extending upwardly from the cabinet. The integrated wall may be made predominantly from fiberglass, whereupon the cabinet may have a rigid frame within the wall and a rigid floor within the frame.

In a preferred embodiment, the structure is an integrated structure comprising an upper, tubular pole, a lower, tubular pole, and a hollow cabinet having at least one door. Thus, the upper pole extends upwardly from the cabinet and serves as means for mounting an antenna. The lower pole extends downwardly from the cabinet and serves as means for elevating the cabinet. Also, the integrated wall defines and encloses the upper and lower poles and the cabinet, except where the cabinet has at least one door.

In an alternative embodiment, the structure comprises an upper, tubular pole, a lower, tubular pole, and a hollow cabinet, which has at least one door and a tubular flange extending upwardly. The upper pole is telescoped over the tubular flange so as to extend upwardly from the cabinet and communicates with the cabinet. The lower pole extends downwardly from and communicates with the cabinet. Also, an integrated wall defines and encloses the lower pole and the cabinet, except where the cabinet has at least one door.

These and other objects, features, and advantages of this invention are evident from the following description of two contemplated embodiments of this invention with reference to the accompanying drawings.

BRIEF DESCRIPTION OF THE DRAWINGS

FIG. 1 is a perspective view of an integrated structure comprised of a hollow cabinet, an upper, tubular pole extending upwardly from the cabinet and mounting an array of antennas, and a lower, tubular pole extending downwardly from the cabinet and being erected by being imbedded in an earthen bed, the integrated structure constituting a preferred embodiment of this invention.

FIG. 2 is a sectional view taken along line 2—2 of FIG. 1, in a direction indicated by arrows.

FIG. 3 is a fragmentary, perspective view of an alternative embodiment, in which the lower pole is erected on a concrete foundation via a flanged collar.

DETAILED DESCRIPTION OF THE ILLUSTRATED EMBODIMENTS

Figure 4:
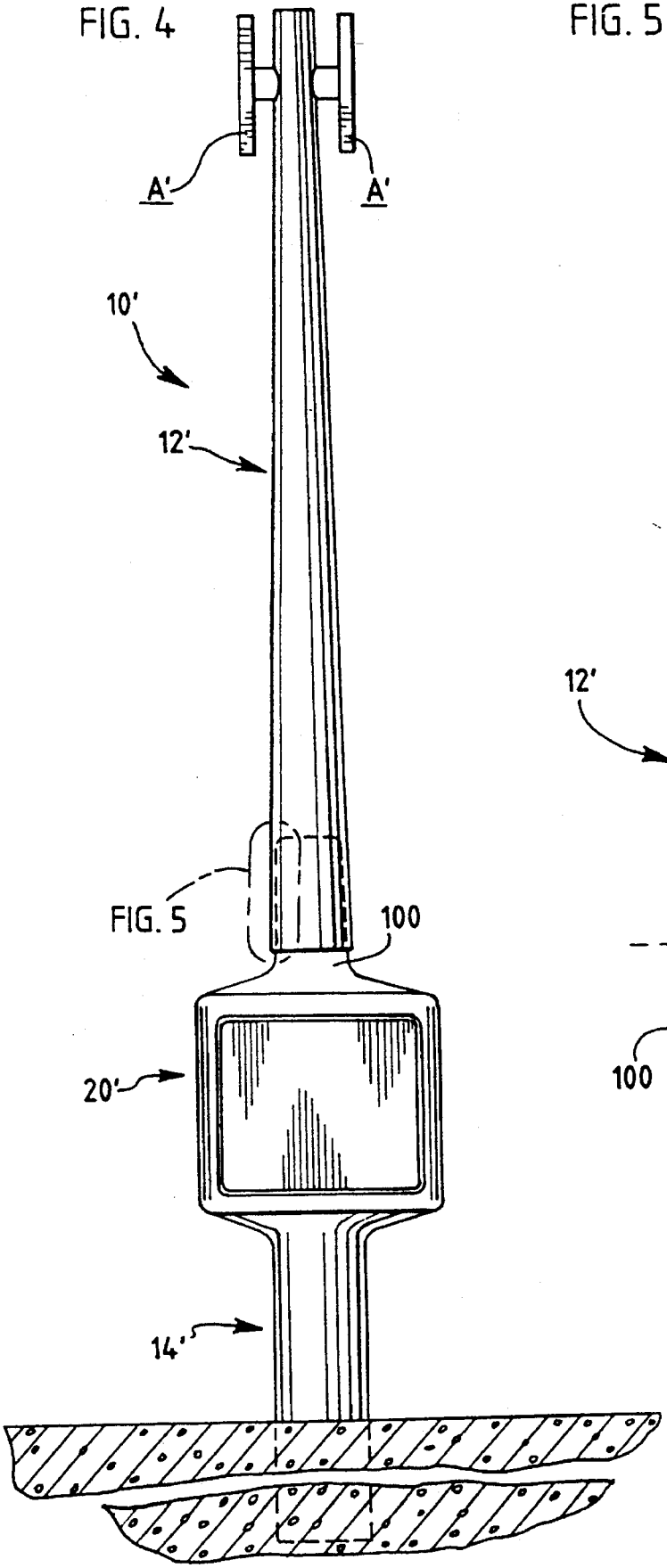
FIG. 4 is a partly fragmentary, elevational view of an alternative structure comprised of a hollow cabinet having an upper, tubular flange, an upper, tubular pole fitting over the tubular flange, extending upwardly from the cabinet, and mounting an array of antennas, and a lower, tubular pole integral with the cabinet and erected by being imbedded in an earthen bed, the alternative structure constituting a preferred embodiment of this invention.

As shown in FIGS. 1, 2, and 3, an integrated structure 10 mounting an array of antennas A at a communications site for cellular telephone communications, personal communication systems, or other wireless communications constitutes a preferred embodiment of this invention.

The integrated structure 10 comprises an upper, tubular pole 12, a lower, tubular pole 14, and a hollow cabinet 20 containing electrical equipment E and having four side walls 22, each being provided with a door 24. The upper pole 12 extends upwardly from the cabinet 20 and serves as means for mounting two antennas A. The lower pole 14 extends downwardly from the cabinet 20 and serves as means for elevating the cabinet 20. The upper pole 12 and the lower pole 14 are tapered upwardly and inwardly, along a common, imaginary cone.

As shown, the cabinet 20 bulges outwardly from the respective poles 12, 14, so that the cabinet 20 when measured in any horizontal plane between an upper portion of the cabinet 20 and a lower portion of the cabinet 20 has a peripheral measurement substantially greater than the peripheral measurement of the upper pole 12 when measured in any horizontal plane above the upper portion of the cabinet 20 and substantially greater than the peripheral measurement of the lower pole 14 when measured in any horizontal plane below the lower portion of the cabinet 20.

The integrated structure 10 has an integrated wall 30, which defines and encloses the upper pole 12, the lower pole 14, and the cabinet 20, except where the cabinet has the doors 24. Preferably, as shown, the integrated wall 30 is a unitary wall, which is made at least predominantly from fiberglass. The integrated wall 30 may be internally or externally coated with a metallic film (not shown) in a known manner for shielding against electromagnetic interference.

The cabinet 20 has a steel frame 40 within the integrated wall 30. Also, the cabinet 20 has a steel floor 42, which supported by and within the steel frame 40. The steel floor 42 may be imperforate, perforated, or made from welded wires.

Each door 24 may be also made predominantly from fiberglass and may have steel reinforcements (not shown) or may be made predominantly from sheet steel. Each door 24 is hinged along one edge 50, via a suitable hinge 52, to one of the walls 22 of the cabinet 20. Each door 24 has a lock 60, which enables such door 24 to be locked to the steel frame 40, in a closed position. Suitable weatherproofing gaskets 70 are provided on each wall 22 where the associated door 24 closes against such wall 22.

As shown in a preferred arrangement in FIG. 1, the lower pole 14 is imbedded in an earthen bed 80, at a lower end 82 of the lower pole 14, so as to mount the integrated structure 10 and so as to elevate the cabinet 20 above the earthen bed 80. A concrete or other solid mass may be used to stabilize such pole 14. As shown in an alternative arrangement in FIG. 3, the lower pole 14 is secured on a concrete foundation 90 by a flanged collar 92 secured to the concrete foundation 90 with suitable anchoring bolts 94, so as to erect the integrated structure 10 and serves as means for elevating the cabinet 20 above the concrete foundation 90.

Electrical cables (not shown) may be run through the earthen bed 80 or the concrete foundation 90, through the lower pole 14, to the electrical equipment E contained by the cabinet 20. Electrical cables (not shown) may be run from such equipment E, through the upper pole 12, through cable outlets (not shown) in the upper pole 12, to the antennas A. Details of the antennas, electrical equipment, and electrical cables are outside the scope of this invention and can be supplied by persons having ordinary skill in the art.

Figure 5:
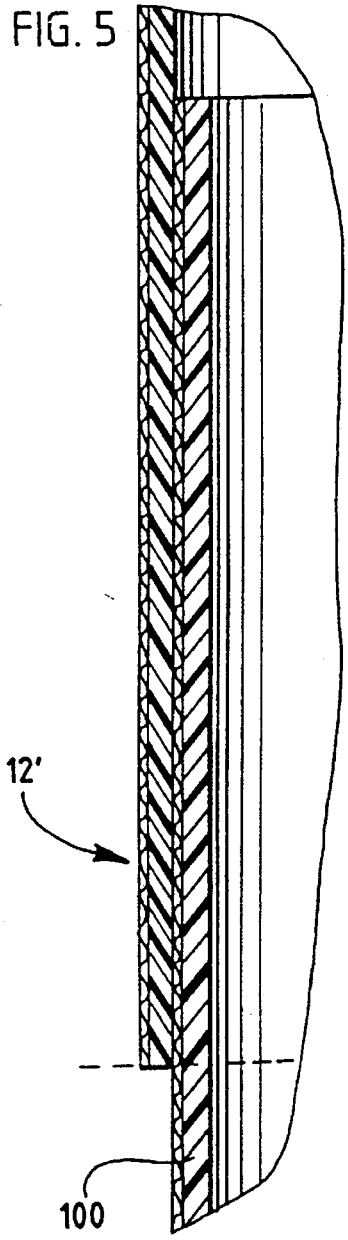
FIG. 5 is a greatly enlarged detail taken within an oblong region indicated in FIG. 4.

As shown in FIGS. 4 and 5, wherein primed reference numbers refer to components similar to components referenced by similar, unprimed reference numbers in FIGS. 1, 2, and 3, an alternative structure 10' mounting an array of antennas A' constitutes an alternative embodiment of this invention.

The alternative structure 10' is similar to the integrated structure 10 and is erected similarly except that the upper, tubular pole 12' is separate from the cabinet 20' and the lower, tubular pole 14', and except that the cabinet 20' has an upwardly extending, tubular flange 100, which is tapered as the tubular pole 12' is tapered, and over which the upper pole 12' is telescoped. There is sufficient friction between the upper pole 12' and the flange 100 to secure the upper pole 12'. As shown, the cabinet 20' and the lower, tubular pole 14' have a unitary, fiberglass wall, except where the cabinet 20' has at least one door.

Because of this invention, there is no need to strap a separate cabinet to such pole, to mount such a pole and a separate cabinet on a common foundation, or to mount a separate cabinet near such a pole in some other manner. Thus, if local ordinances permit, a utility easement may suffice and there may be no need for a building permit. Moreover, exposure of electrical cables is minimized, particularly at low levels where electrical cables are susceptible to damage due to accidents or vandalism. Furthermore, aesthetics are improved.

Various modifications may be made in the illustrated and described embodiments without departing from the scope and spirit of this invention.

I claim:

1. A structure for mounting an antenna at a communications site, said structure comprising an upper, tubular pole, a lower, tubular pole, and a hollow cabinet having at least one door, the upper pole extending upwardly from the cabinet and serving as means for mounting an antenna, the lower pole extending downwardly from the cabinet and serving as means for elevating the cabinet, said structure having a unitary, fiberglass wall, which defines and encloses the upper and lower poles and the cabinet, except where the cabinet has at least one door, the cabinet bulging outwardly from the upper and lower poles so that the cabinet when measured in any horizontal plane between an upper portion of the cabinet and a lower portion of the cabinet has a peripheral measurement substantially greater than the peripheral measurement of the upper pole when measured in any horizontal plane above the upper portion of the cabinet and substantially greater than the peripheral measurement of the lower pole when measured in any horizontal plane below the lower portion of the cabinet.

2. The structure of claim 1 wherein the cabinet has a rigid frame within said wall and wherein the rigid frame is made of steel.

3. The integrated structure of claim 2 wherein the cabinet has a rigid floor within said rigid frame.

4. The integrated structure of claim 3 wherein the rigid frame and the rigid floor are made of steel.

5. A structure for mounting an antenna at a communications site, said structure comprising an upper, tubular pole, a lower, tubular pole, and a hollow cabinet, the cabinet having at least one door and a tubular flange extending upwardly, the upper pole being telescoped over the tubular flange so as to extend upwardly from the cabinet, the upper pole communicating with the cabinet and serving as means for mounting an antenna, the lower pole extending downwardly from and communicating with the cabinet and serving as means for elevating the cabinet, the structure having a unitary, fiberglass wall, which defines and encloses the lower pole and the cabinet, the cabinet bulging outwardly from the upper and lower poles so that the cabinet when measured in any horizontal plane between an upper portion of the cabinet and a lower portion of the cabinet has a peripheral measurement substantially greater than the peripheral measurement of the upper pole when measured in any horizontal plane above the upper portion of the cabinet and substantially greater than the peripheral measurement of the lower pole when measured in any horizontal plane below the lower portion of the cabinet.

* * * * *